US006159002A

United States Patent [19]

LeJeune

[11] Patent Number: 6,159,002

[45] Date of Patent: Dec. 12, 2000

[54] OIL CANDLE HAVING AN OIL SEAL

[75] Inventor: Eugene M. LeJeune, Slinger, Wis.

[73] Assignee: Lamplight Farms, Inc., Menomonee Falls, Wis.

[21] Appl. No.: 09/563,832

[22] Filed: May 5, 2000

[51] Int. Cl.[7] ..... F23D 3/18

[52] U.S. Cl. ..... 431/324; 431/321; 431/323

[58] Field of Search ..... 431/320, 321, 431/322, 323, 324, 33, 34; 126/43, 45, 47; 217/105; 362/159, 161

[56] References Cited

U.S. PATENT DOCUMENTS

| | | | |
|---|---|---|---|
| 1,281,077 | 10/1918 | Schlepp | 431/324 |
| 1,524,501 | 1/1925 | Baummer, Jr. | 217/105 |
| 2,512,885 | 6/1950 | Archambeau | 67/55 |
| 3,097,514 | 7/1963 | Stone | 431/324 |
| 3,321,938 | 5/1967 | Bureau | 431/321 |
| 3,994,672 | 11/1976 | Novak | 431/324 |
| 4,035,138 | 7/1977 | Walters | 431/320 |
| 4,526,530 | 7/1985 | Menter et al. | 431/34 |
| 4,624,633 | 11/1986 | Bandel | 431/320 |
| 4,911,139 | 3/1990 | Yost | 431/324 |
| 5,840,257 | 11/1998 | Bureau et al. | 431/320 |

*Primary Examiner*—Ira S. Lazarus
*Assistant Examiner*—Josiah C. Cocks
*Attorney, Agent, or Firm*—Donald J. Ersler

[57] ABSTRACT

An oil candle having an oil seal includes an oil seal, oil candle base, quantity of oil, and glass wick tube. The oil seal includes a tapered cylinder with a bore down substantially a middle thereof. The bore is sized to slidably receive a standard size glass wick tube. A notch is cut down the length of the oil seal to allow air flow between the outside environment and the inside of the oil candle base. The cross section of the notch is small enough to prevent oil from dripping through thereof, if the oil candle base is knocked over. The oil seal is sized to be firmly received by a mouth of the oil candle base when on the glass wick tube.

1 Claim, 5 Drawing Sheets

OIL CANDLE HAVING AN OIL SEAL

BACKGROUND OF THE INVENTION

1. Field of the Invention

The present invention relates generally to oil candles and more specifically to an oil candle having an oil seal which firmly retains a glass wick tube within a mouth thereof.

2. Discussion of the Prior Art

Many oil candles utilize glass wick tubes. A glass wick tube is a glass tube with an ignitable wick inserted down the center thereof. The glass tube forces the ignitable wick to be positioned at the bottom of the oil candle base. Oil candle bases are fabricated of glass with glass mouths. It is impossible to create a firm fit between the glass mouth of the oil candle base and the glass wick tube. The lack of firm fit between the glass mouth and glass wick tube allows the glass wick tube to be easily pulled out of the mouth of the oil candle base. The removability of the glass wick tube may result in two types of hazards. First, a child may pull the glass wick tube out of the oil candle base and drink the oil therein. Oil is hazardous and can be harmful or fatal if swallowed. Second, if the oil candle is inadvertently knocked over, the glass wick tube may slip out of the oil candle base. The result of the glass wick tube slipping out of the oil candle base, may be a fire fed by the oil inside the oil bottle.

Accordingly, there is a clearly felt need in the art for an oil candle with an oil seal which does not allow a glass wick tube to be easily removed from the oil candle base by a child or to easily fall out if the oil candle is knocked over.

SUMMARY OF THE INVENTION

The present invention provides an oil candle having an oil seal which firmly retains a glass wick tube within the mouth thereof. The oil candle having an oil seal includes an oil seal, oil candle base, quantity of oil, glass wick tube, and ignitable wick. The oil seal includes a tapered cylinder with a bore (or inner diameter) down substantially a middle thereof. The bore is sized to slidably receive the glass wick tube. A notch is cut down the length of the oil seal to allow air flow between the outside environment and the inside of the oil candle base. The cross-section of the notch is preferably small enough to prevent oil from dripping through thereof, if the oil candle base is tipped over.

The oil candle with an oil seal is preferably assembled in the following manner. The manufacturer preferably inserts the ignitable wick into the glass wick tube and slips the oil seal over the glass wick tube to a top thereof. The end user preferably fills the oil candle base with the quantity of oil and inserts the glass wick tube with the oil seal into the mouth of the oil candle base until the mouth firmly retains the glass wick tube.

Accordingly, it is an object of the present invention to provide an oil seal which securely retains a glass wick tube in the mouth thereof.

It is a further object of the present invention to provide an oil seal which prevents a child from drinking the oil contained in an oil candle.

Finally, it is another object of the present invention to provide an oil seal which prevents a fire if the oil candle is accidentally knocked over.

These and additional objects, advantages, features and benefits of the present invention will become apparent from the following specification.

DETAILED DESCRIPTION OF THE PREFERRED EMBODIMENTS

Figure 1:
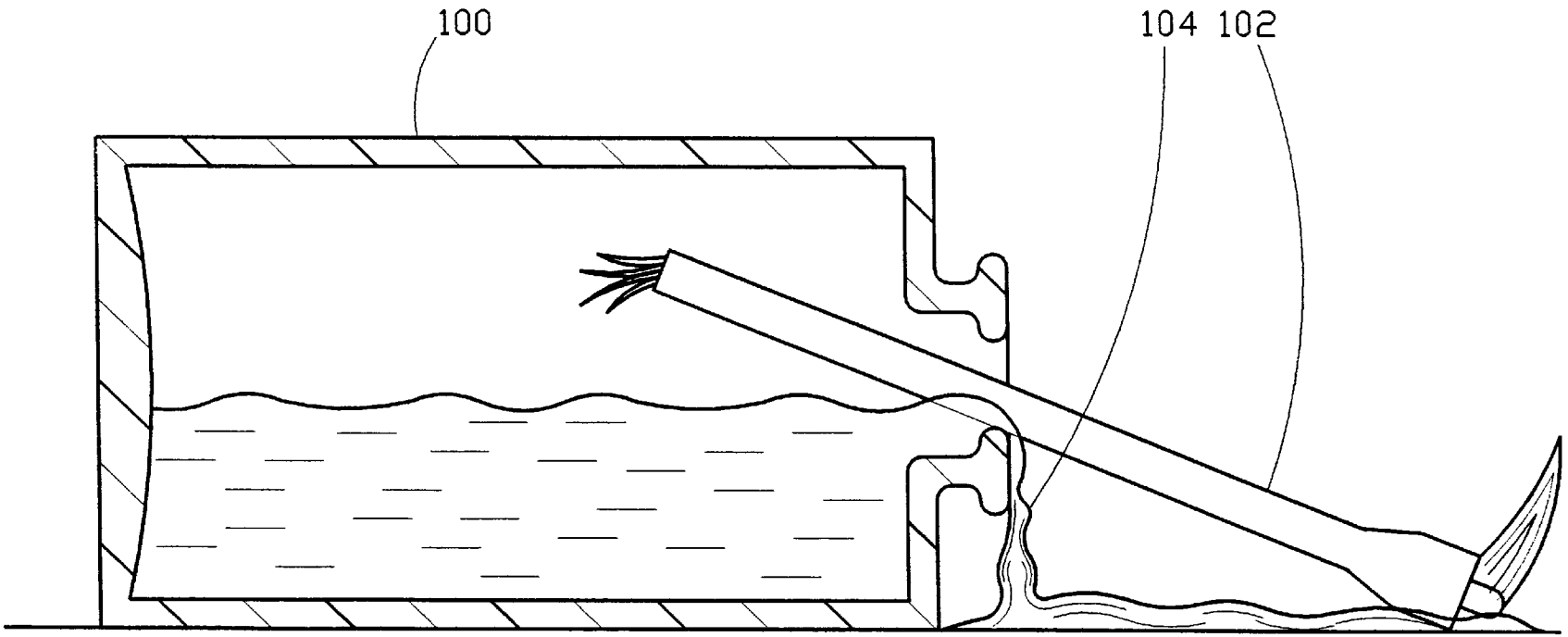
Fig. 1 (Prior Art)
FIG. 1 is a side view of a prior art oil candle which has been accidentally knocked over.
Figure 2:
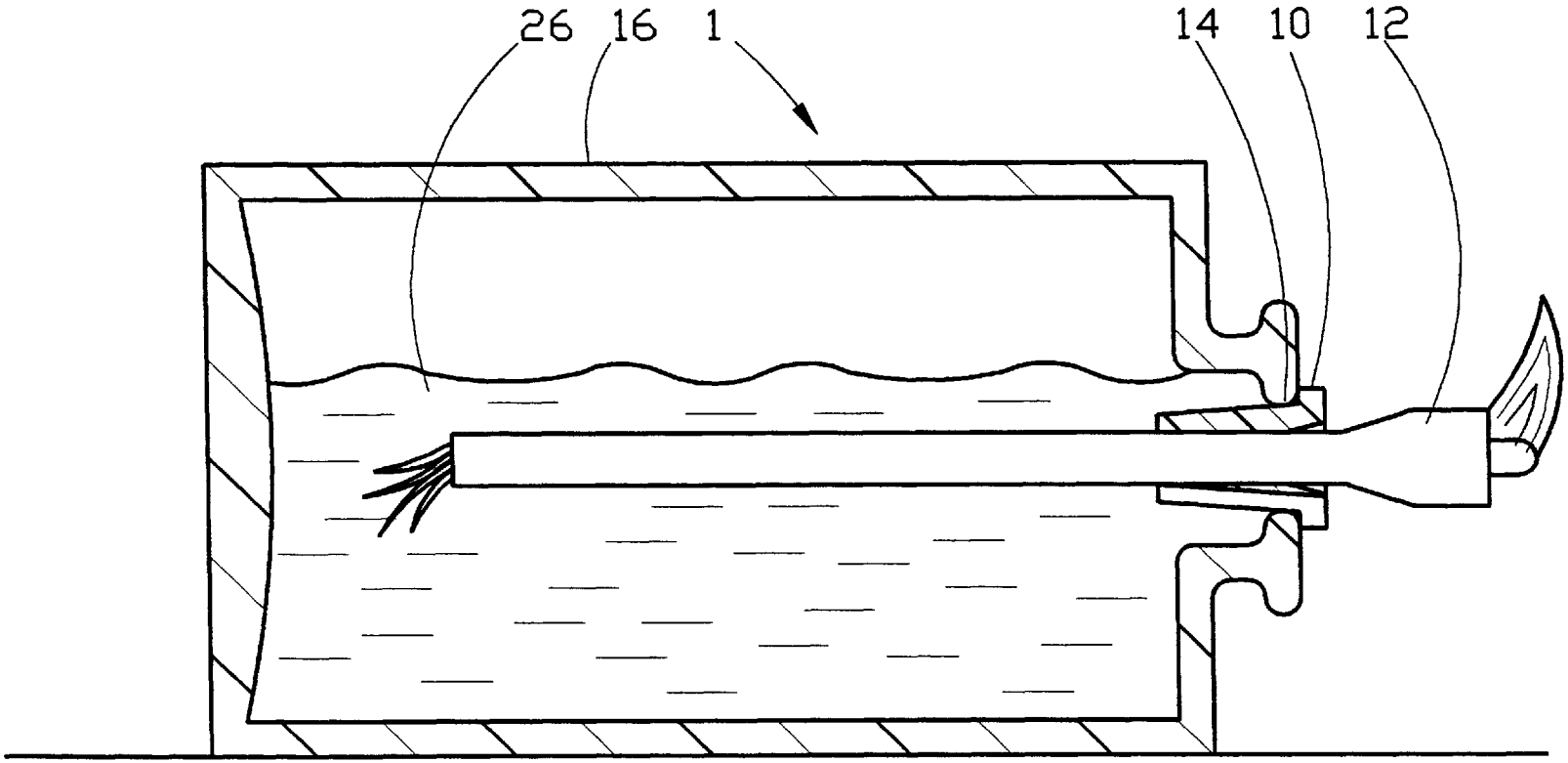
FIG. 2 is a side view of an oil candle having an oil seal which has been accidentally knocked over in accordance with the present invention.

With reference now to the drawings, and particularly to FIG. 2, there is shown a cross sectional view of an oil candle having an oil seal 1 that has been knocked on its side. FIG. 1 shows a prior art oil candle 100 with a glass wick tube 102 that has been knocked on its side. Sometimes, the force of impact which knocks over the oil candle 100 also causes the glass wick tube 102 to slide out of the oil candle 100 as shown in FIG. 1. If the oil candle 100 was lit, a fire may be fed by the quantity of oil 104 which spills out of the oil candle 100. In FIG. 2, an oil candle having an oil seal 1 retains a glass wick tube 12 and prevents a quantity of oil 26 from spilling out of the oil candle 1. The fact that the glass wick tube 102 may be easily removed from the oil candle 100 may present a child with the opportunity to drink the oil 104 therein.

Figure 3:
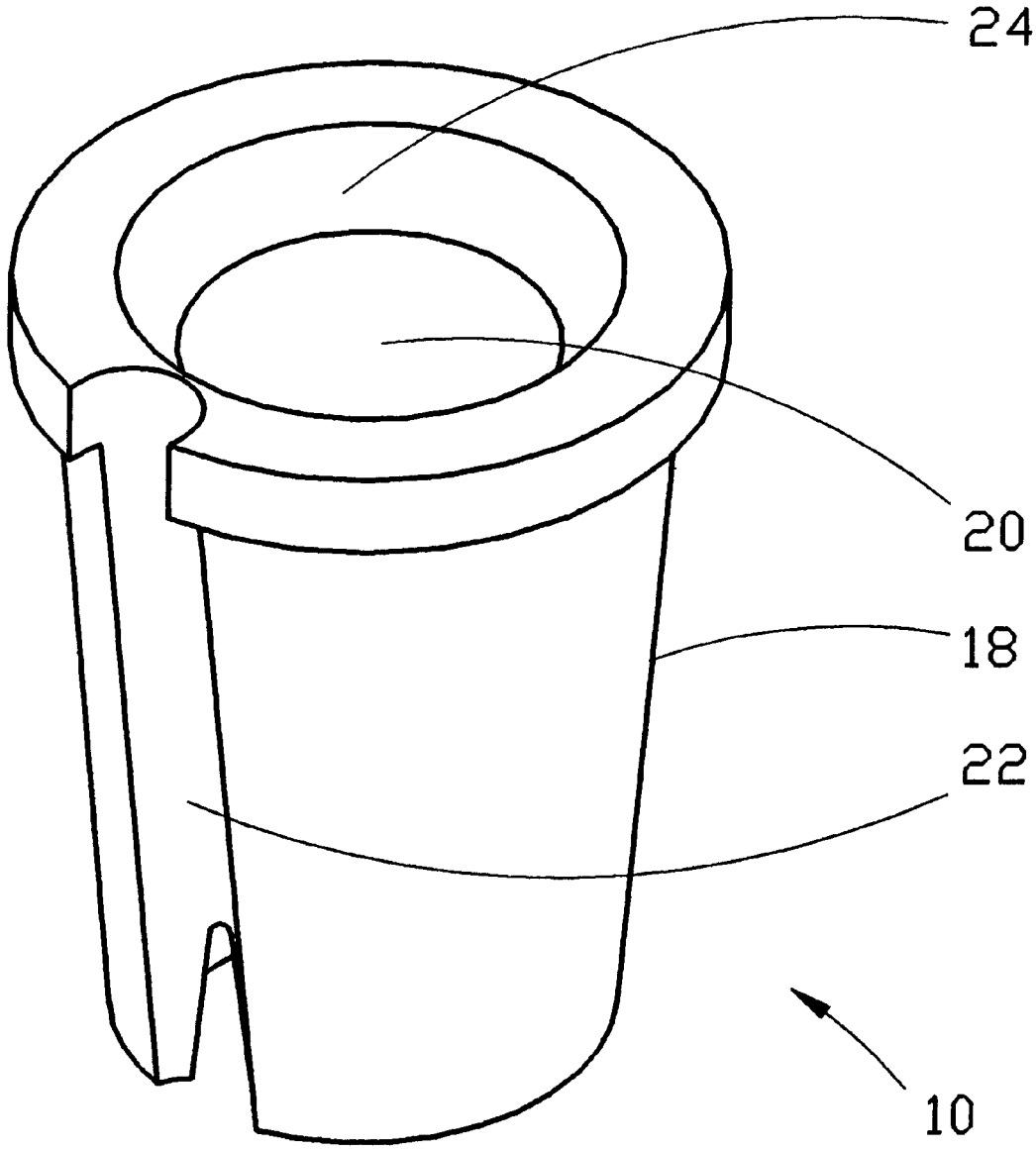
FIG. 3 is a perspective view of an oil seal in accordance with the present invention.
Figure 4:
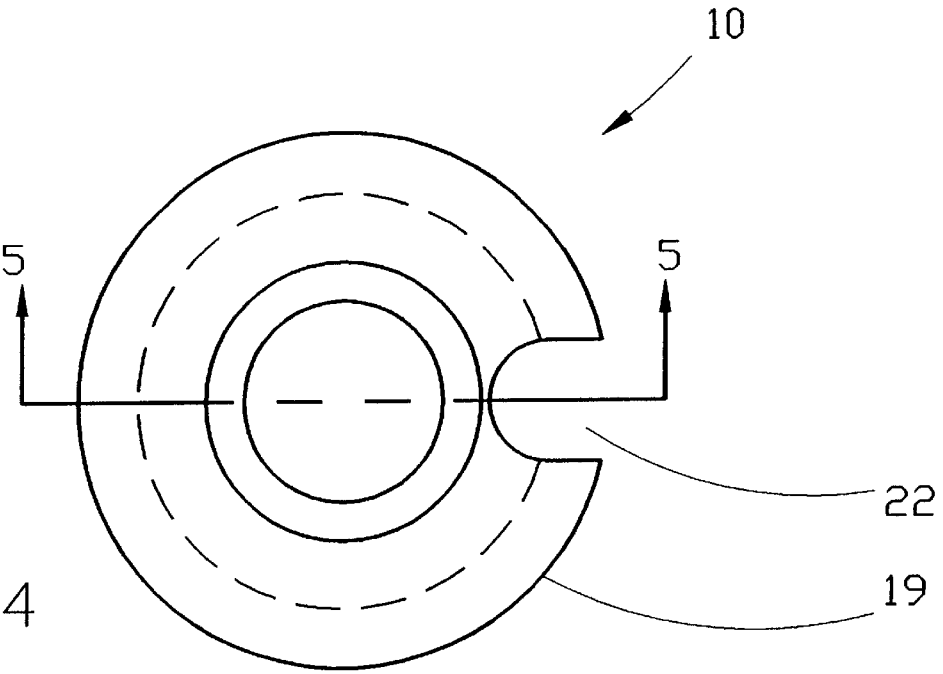
FIG. 4 is an enlarged top view of an oil seal in accordance with the present invention.
Figure 5:
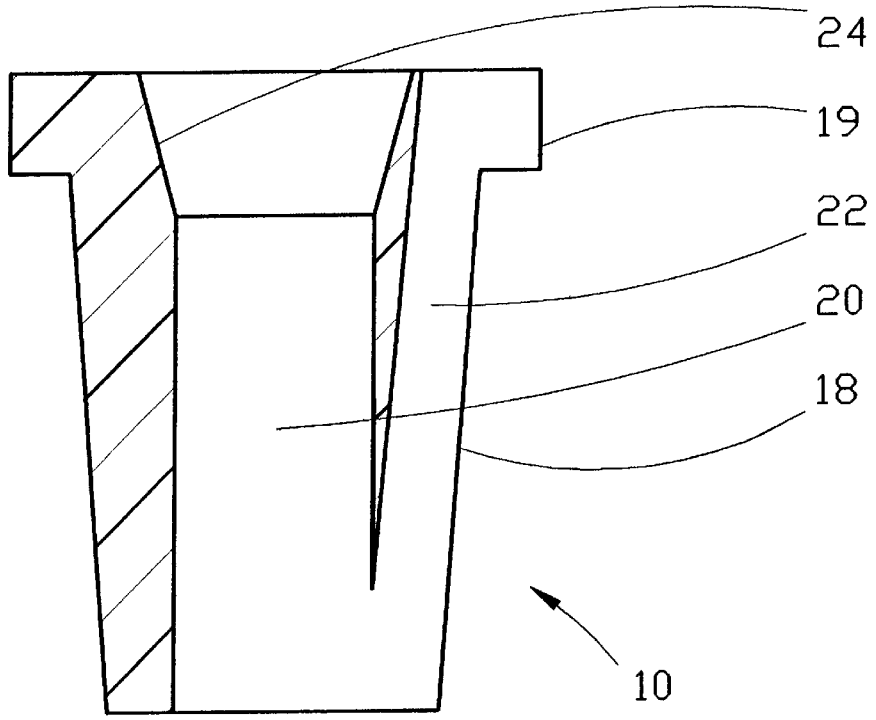
FIG. 5 is an enlarged cross sectional view of an oil seal in accordance with the present invention.

With reference to FIG. 3–the oil seal 10 includes a tapered cylinder body 18 with a bore 20 (or inner diameter) formed through substantially a middle thereof. A shoulder 19 is preferably formed on a top of the oil seal 10 to prevent thereof from slipping through a mouth 14 of an oil candle base 16. The oil seal 10 is preferably fabricated from a resilient and high temperature plastic such as Elastollan C75A15W or rubber such as Buna-N. Other plastics and rubbers may also be used. It is preferable that the plastic or rubber be translucent.

Figure 6:
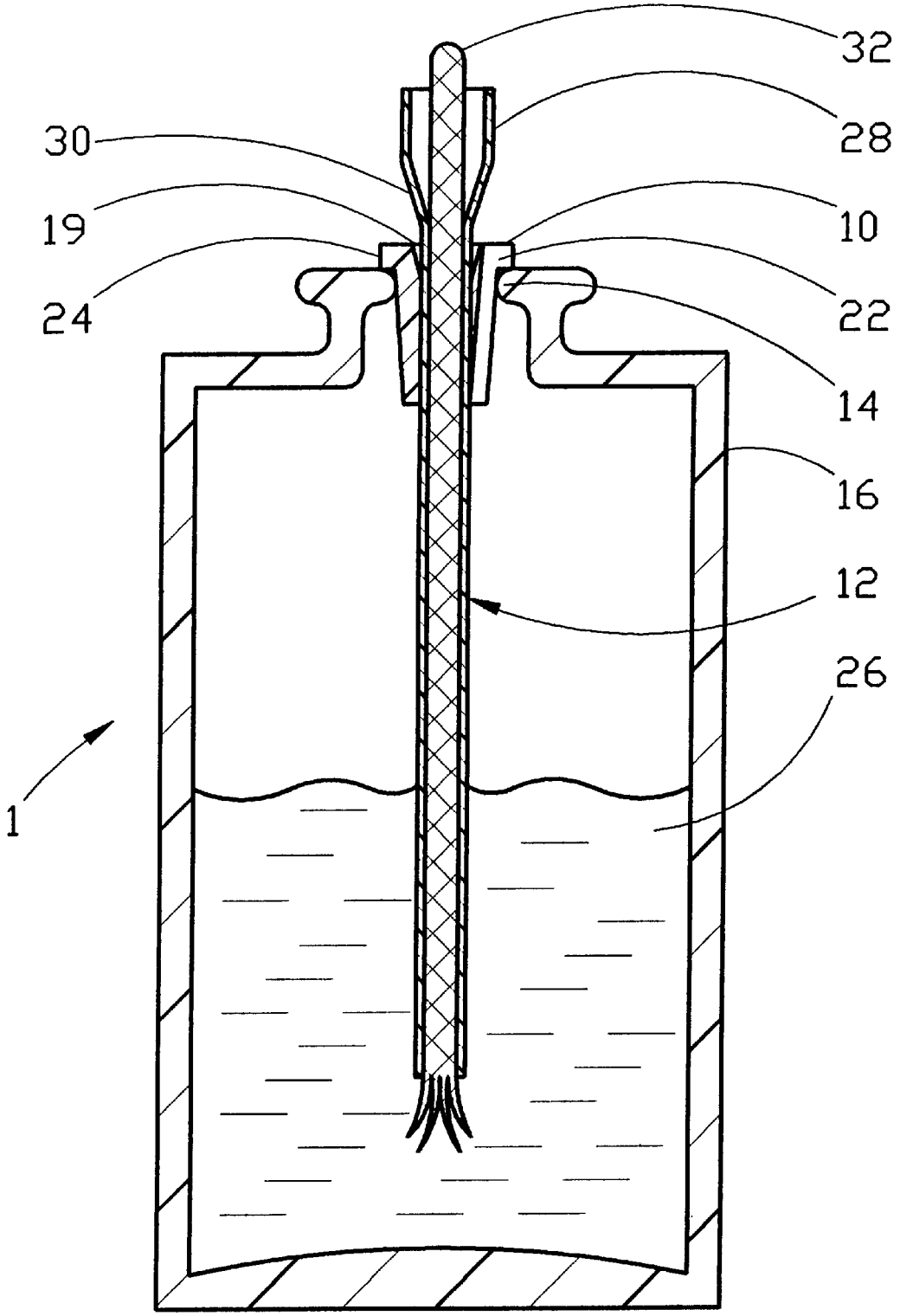
FIG. 6 is a cross sectional view of an oil candle with an oil seal installed therein in accordance with the present invention.

The bore 20 is sized to slidably receive an outer body diameter of the glass wick tube 12. A notch 22 is cut down the length of the oil seal 10 to allow air flow between the outside environment and the inside of the oil candle base 16. The cross section of the notch 22 preferably has a semi-circle shape. The size of the notch 22 is small enough to prevent the quantity of oil 26 from dripping through the mouth 14, if the oil candle base 16 is tipped over. A chamfer 24 is preferably formed at a top of the bore 20 to facilitate insertion of the glass wick tube 12 into the oil seal 10. With reference to FIG. 6, the chamfer 24 will also provide a snug fit between the sloped area 30 on a bottom of a flame flange 28, disposed at a top of the glass wick tube 12.

FIG. 6 shows a cross sectional view of an oil candle having an oil seal 1. The oil candle having an oil seal 1 includes the oil candle base 16, oil seal 10, quantity of oil 26, glass wick tube 12, and an ignitable wick 32. The oil candle with an oil seal 1 is preferably assembled in the following manner. The manufacturer preferably inserts the ignitable wick 32 into the glass wick tube 12 such that a portion of the ignitable wick 32 protrudes into the flame boss and out of a bottom of the glass wick tube 12. The oil seal 10 is slipped over the glass wick tube 28 and pushed up such that the chamfer 24 snugs against the sloped area 30. The end user preferably fills the oil candle base 16 with the quantity of oil 26 and inserts the glass wick tube 12 with the oil seal 10 into the mouth 14 of the oil candle base 16 until the mouth firmly retains the glass wick tube 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An oil candle having an oil seal comprising:

an oil candle base having a mouth, said oil candle base being filled with a quantity of oil;

a glass wick tube having an ignitable wick in a center thereof; and an oil seal having an inner diameter which receives said glass wick tube, a chamfer being formed on a top of said inner diameter to facilitate insertion of said glass wick tube, said oil seal having a tapered outer diameter which is sized to firmly fit inside said mouth, said outer diameter having the greatest dimension at the top thereof, said oil seal having a notch formed along substantially a length thereof, and said oil seal being fabricated from a high temperature plastic.

* * * * *